US010422191B2

(12) United States Patent
Richards

(10) Patent No.: US 10,422,191 B2
(45) Date of Patent: Sep. 24, 2019

(54) MULTIPLE CONTROL LINE TRAVEL JOINT WITH ENHANCED STROKE POSITION SETTING

(71) Applicant: Halliburton Energy Services, Inc., Houston, TX (US)

(72) Inventor: William Mark Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 248 days.

(21) Appl. No.: 15/526,799

(22) PCT Filed: Dec. 19, 2014

(86) PCT No.: PCT/US2014/071600
§ 371 (c)(1),
(2) Date: May 15, 2017

(87) PCT Pub. No.: WO2016/099560
PCT Pub. Date: Jun. 23, 2016

(65) Prior Publication Data

US 2017/0328141 A1 Nov. 16, 2017

(51) Int. Cl.
*E21B 17/07* (2006.01)
*E21B 33/04* (2006.01)
(Continued)

(52) U.S. Cl.
CPC ..... *E21B 17/07* (2013.01); *E21B 33/04* (2013.01); *E21B 43/10* (2013.01); *E21B 33/12* (2013.01)

(58) Field of Classification Search
CPC ..... E21B 17/07; E21B 33/04; E21B 33/12; E21B 43/10
See application file for complete search history.

(56) References Cited

U.S. PATENT DOCUMENTS 4,059,153 A 11/1977 Nix et al.
6,540,025 B2 * 4/2003 Scott ..... E21B 17/07 166/338
(Continued)

FOREIGN PATENT DOCUMENTS

WO 2014/130032 A1 8/2014
WO 2014/193419 A1 12/2014
(Continued)

OTHER PUBLICATIONS

International Preliminary Report on Patentability issued in related Application No. PCT/US2014/071600, dated Jun. 29, 2017 (13 pages).
(Continued)

*Primary Examiner* — Giovanna C Wright
*Assistant Examiner* — Yanick A Akaragwe
(74) *Attorney, Agent, or Firm* — Benjamin Fite; Baker Botts L.L.P.

(57) ABSTRACT

In accordance with embodiments of the present disclosure, a travel joint includes a tube disposed at one end of the travel joint and a mandrel disposed at an opposite end of the travel joint. The mandrel is partially disposed in a hollow portion of the tube, and the tube and the mandrel are axially slidable relative to each other to extend or compress the travel joint. The travel joint also may include a housing coupled to the tube and disposed around the mandrel and a locking mechanism between the housing and the mandrel disposed in a position to selectively lock the mandrel and the tube in an axial position relative to each other to partially compress the travel joint. In some embodiments, the travel joint may include a fluid brake having a fluid chamber disposed between the mandrel and the tube to dampen axial movement between the mandrel and tube.

18 Claims, 6 Drawing Sheets

(51) Int. Cl.
*E21B 43/10* (2006.01)
*E21B 33/12* (2006.01)

(56) References Cited

U.S. PATENT DOCUMENTS

| | | | |
|---|---|---|---|
| 8,915,304 | B2 | 12/2014 | Richards et al. |
| 2002/0092653 | A1 | 7/2002 | Scott et al. |
| 2003/0029621 | A1 | 2/2003 | Haynes |
| 2009/0145605 | A1 | 6/2009 | Kratochvil et al. |
| 2013/0025880 | A1 | 1/2013 | Richards et al. |

FOREIGN PATENT DOCUMENTS

| | | | |
|---|---|---|---|
| WO | 2014/193420 | A1 | 12/2014 |
| WO | 2015/005895 | A1 | 1/2015 |
| WO | 2015/005897 | A1 | 1/2015 |
| WO | 2015/174955 | A1 | 11/2015 |

OTHER PUBLICATIONS

"Pressure Activated Compaction Travel Joint", IP.com Prior Art Technical Disclosure, Disclosed Anonymously, IP.Com No. 000240041, Dec. 24, 2014, 5 pages.
International Search Report and Written Opinion issued in related PCT Application No. PCT/US2014/071600 dated Aug. 26, 2015, 16 pages.

* cited by examiner

MULTIPLE CONTROL LINE TRAVEL JOINT WITH ENHANCED STROKE POSITION SETTING

CROSS-REFERENCE TO RELATED APPLICATION

The present application is a U.S. National Stage Application of International Application No. PCT/US2014/071600 filed Dec. 19, 2014, which is incorporated herein by reference in its entirety for all purposes.

TECHNICAL FIELD

The present disclosure relates generally to travel joint systems and, more particularly, to a travel joint that can be positioned in different configurations for installation within a wellbore.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

After drilling a wellbore that intersects a subterranean hydrocarbon-bearing formation, a variety of wellbore tools may be positioned in the wellbore during completion, production, or remedial activities. It is common practice in completing oil and gas wells to set a string of tubular, known as known as a production tubing string, in the well to direct hydrocarbons from a perforated section of the formation to the surface. A travel joint may be used in a production tubing string for installing a tubing hanger inside a wellhead after engaging the completion equipment with the production tubing string. The travel joint allows the production tubing string to shorten by axially telescoping the assembly, in order to effectively land the tubing hanger in the wellhead while the production tubing string is stabbed into the completion equipment at the bottom of the well.

Existing travel joints are often deployed from the surface in an extended position. After landing the production tubing at the bottom of the well, the travel joint is then released for telescoping or longitudinally collapsing by any suitable means until the tubing hanger is landed in the wellhead. However, such travel joints typically do not account for temperature changes that might otherwise force the travel joint in an extended direction instead of a collapsed direction when the travel joint is released. In addition, applying pressure to the tubing string to actuate an additional tool via hydraulic pressure through the production tubing may lead to residual tension or compression force on the tubing, and this force may be transferred to the travel joint when the travel joint is released. This could cause moving parts of the travel joint to move relative to each other at relatively high speeds, transferring undesirable stresses in control lines routed through the travel joint.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a travel joint that functions to change the length of a tubing string to which the travel joint is coupled. The travel joint may include a tube and a mandrel disposed at least partially inside the tube. The tube may be coupled to production tubing at one end of the travel joint, while the mandrel may be coupled to production tubing at an opposite end of the travel joint. The tube and mandrel are designed to move axially relative to each other, in order to change the length of the production tubing string. The travel joint may include multiple control lines routed therethrough. In some embodiments, the travel joint may be assembled such that it may be locked into one or more positions. For example, the travel joint may be locked into a mid-stroke position (partially extended) or a full stroke position (fully extended). In some embodiments, the travel joint may include one or more locking mechanisms to selectively lock the mandrel in a desired axial position relative to the tube. The disclosed travel joint may include a release mechanism used to release the travel joint from its locked position based on a pressure differential between a tool annulus (between the mandrel and a housing of the travel joint) and the center of the production tubing/mandrel. In some embodiments, the travel joint may include a hydraulic brake that allows for metered stroking of the mandrel relative to the tube in response to high tension or compression loads on the travel joint.

Figure 1:
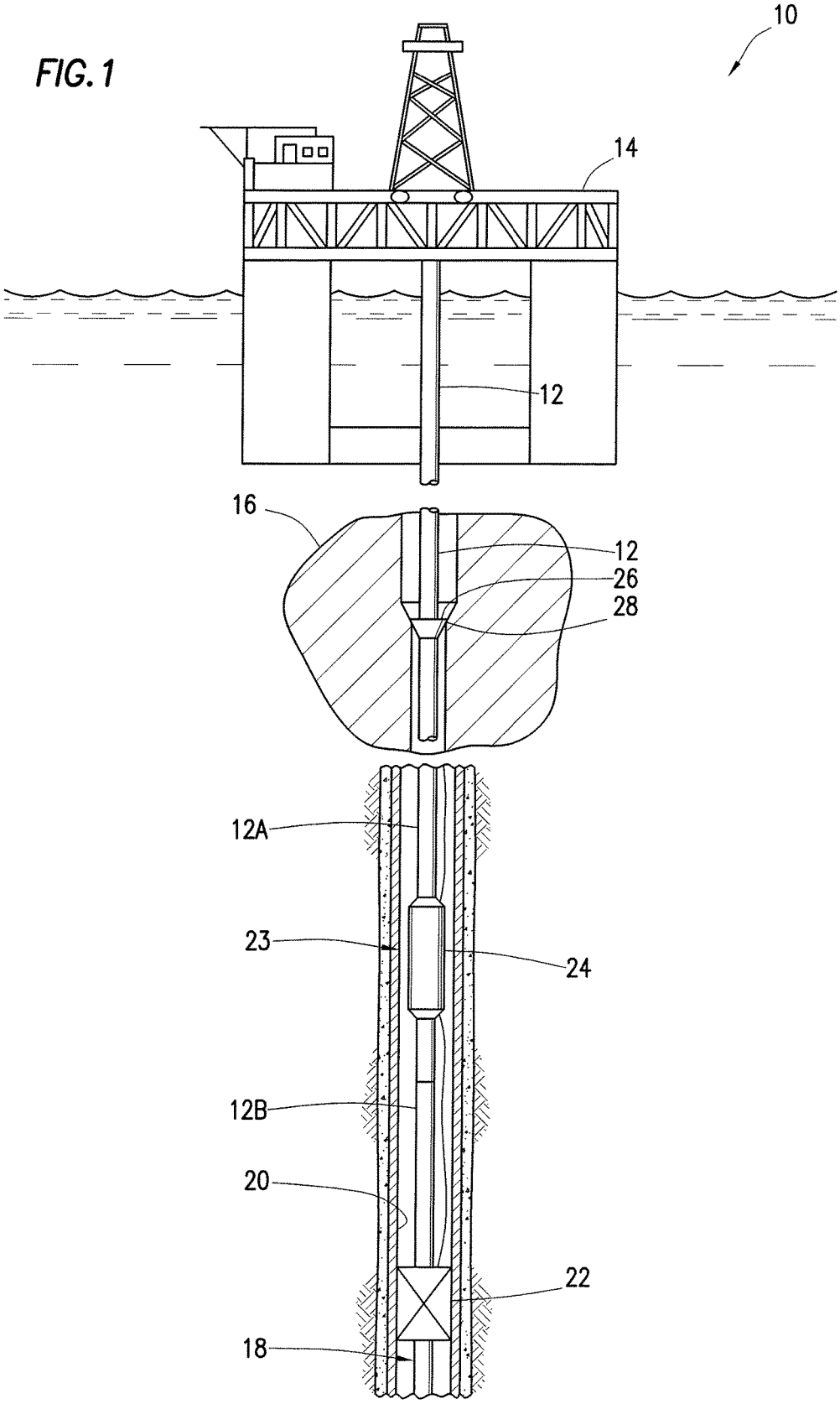
FIG. 1 is a partial cross-sectional view of a travel joint system, in accordance with an embodiment of the present disclosure.

Turning now to the drawings, FIG. 1 illustrates a system 10 for performing subterranean operations in accordance with an illustrative embodiment of the present disclosure. In the system 10, a tubular string 12 extends downwardly from a drilling rig 14. The drilling rig 14 may be a floating platform, drill ship, or jack up rig. In certain illustrative embodiments, the tubular string 12 may be in a riser (not shown) between the drilling rig 14 and a wellhead 16. In other embodiments, a riser may not be used.

The tubular string 12 may be stabbed into a completion assembly 18 previously installed in a wellbore 20. In the illustrative embodiment of FIG. 1, the tubular string 12 may be sealingly disposed in a packer 22 at an upper end of the completion assembly 18. In certain embodiments, the tubular string 12 may have a seal stack (not shown) thereon which seals within a sealed bore receptacle (e.g., above a liner hanger, etc.). The tubular string 12 may be connected with the completion assembly 18 using any desirable coupling mechanism.

The completion assembly 18 may be used to "complete" a portion of the wellbore 20. Completing a wellbore, as used herein, refers to operations performed to prepare the wellbore for production or injection operations. The completion assembly 18 may include one or more elements which facilitate such production or injection operations. For instance, the completion assembly 18 may feature elements including, but not limited to, packers, well screens, perforated liner or casing, production or injection valves, flow control devices, and/or chokes.

A travel joint system 23 may be disposed along the tubular string 12. As illustrated, a first portion of the tubular string 12A may be coupled to a top of the travel joint system 23, and a second portion of the tubular string 12B may be coupled to a bottom of the travel joint system 23. The travel joint system 23 may be used to axially shorten or lengthen the tubular string 12 between the completion assembly 18 and the wellhead 16, while enabling fluid communication between the first and second portions of the tubular string 12A and 12B. After the tubular string 12 has been connected to the completion assembly 18, a travel joint 24 in the tubular string 12 may be released to allow the tubular string 12 to be landed in the wellhead 16. In the example of FIG. 1, a hanger 26 is landed on a wear bushing 28, but other manners of securing a tubular string in a wellhead may be used. The travel joint 24 may permit some variation in the length of the tubular string 12 between the hanger 26 and the completion assembly 18. For instance, the travel joint 24 may allow the length of the tubular string 12 to shorten after the completion assembly 18 has been sealingly engaged, so that the hanger 26 can be appropriately landed in the wellhead 16.

In some instances, the travel joint 24 may allow the length of the tubular string 12 to lengthen once the travel joint 24 is released, in order to accommodate effects of temperature changes on the tubular string 12, travel joint 24, and other downhole components. In such instances, the travel joint 24 may be run into the wellbore in a fully stroked (compressed) position or in a mid-stroke (partially compressed/extended) position. As discussed in more detail below, the travel joint 24 is configured to facilitate locking itself into a mid-stroke or full-stroke position during run in and releasing from the mid-stroke or full-stroke position once downhole. In some embodiments, the travel joint may include multiple locking mechanisms that facilitate configuration of the travel joint in multiple different stroke positions.

Figure 2:
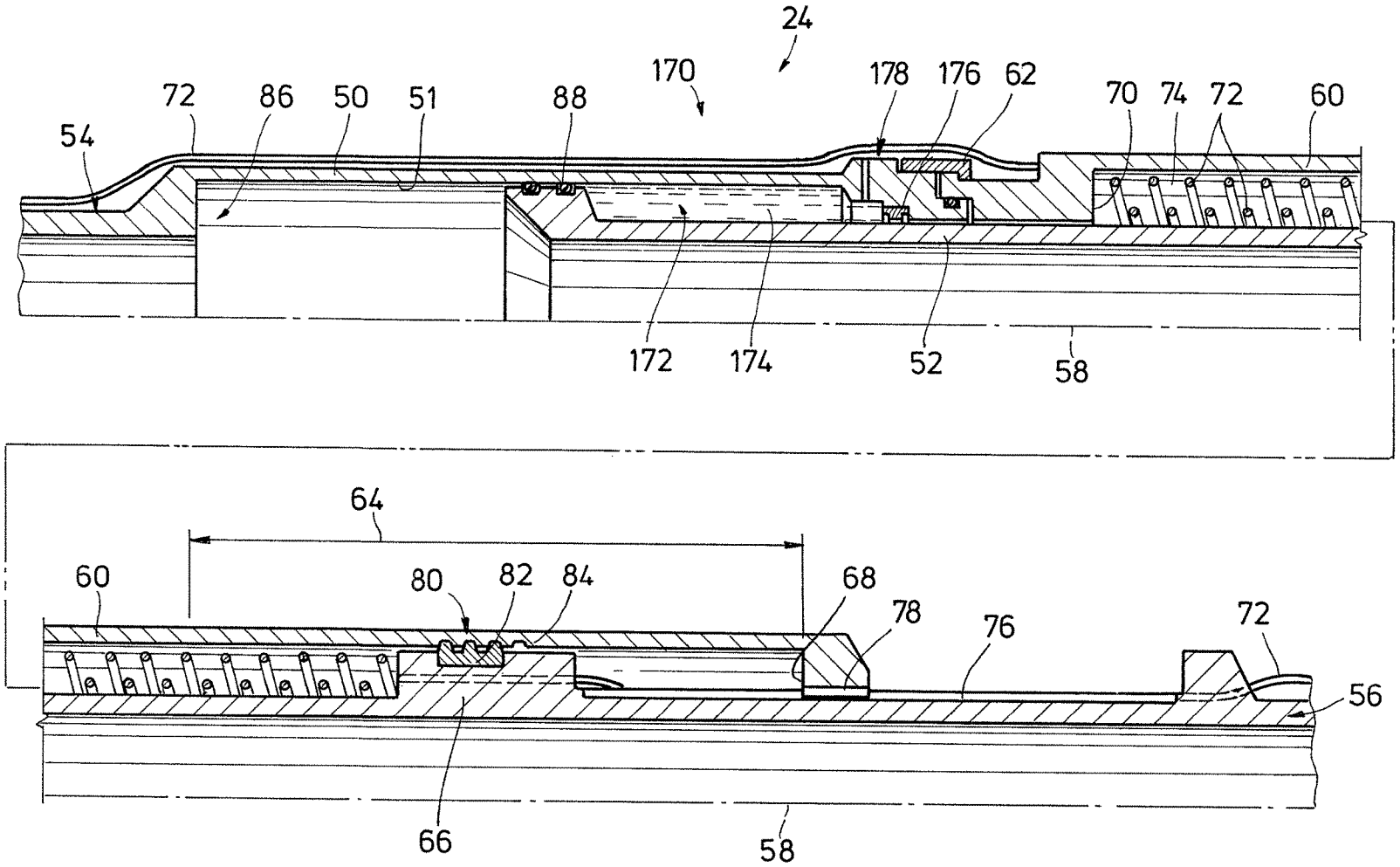
FIG. 2 is a schematic cross sectional view of the travel joint system of FIG. 1, in accordance with an embodiment of the present disclosure.

FIG. 2 illustrates an embodiment of the disclosed travel joint 24 that may be coupled to production tubing. The travel joint 24 includes, among other things, a tube 50 and an inner mandrel 52 disposed at least partially inside a hollow portion of the tube 50. In some embodiments, the tube 50 may be a honed tube or may have a seal surface along the inner diameter 51. The tube 50 forms one end 54 of the travel joint 24 and the mandrel 52 forms another end 56 of the travel joint 24 opposite the tube end 54. This allows the tubular string 12 (as shown in FIG. 1) to be coupled to the tube 50 at the one end 54 of the travel joint 24 and to the mandrel 52 at the opposite end 56. As discussed above, the travel joint 24 enables the lengthening and/or shortening of the tubular string. This may be accomplished, for example, through the mandrel 52 and the tube 50 sliding relative to one another along an axis 58 of the travel joint 24. That is, the tube 50 and the mandrel 52 may be axially slidable relative to each other in order to extend or compress the travel joint 24.

As illustrated, the tube 50 may be coupled to a housing 60 that is disposed around another portion of the mandrel 52. The tube 50 and the housing 60 may be held together by a collar 62 and the space between them may be sealed. Together, the tube 50 and the housing 60 may form an outer component of the travel joint 24 that is disposed around a portion of the mandrel 52. Although shown as a single mandrel in the illustrated embodiment, the mandrel 52 may include one or more mandrel components (e.g., an inner mandrel, lower mandrel, and seal mandrel) that are coupled together. The different mandrel components may be used to interface with different portions of the tube 50, the housing 60, and production tubing coupled to the end 56 of the travel joint 24. Similarly, in some embodiments, the tube 50 and the housing 60 may be generally formed as a single piece outer component or from several outer components coupled together.

The housing 60 and the mandrel 52 may be designed so that the travel joint 24 may have an adjustable length within a specified range. For example and without limitation, the housing 60 and the mandrel 52 may be built to facilitate a change in axial length of up to approximately 45 feet. Whatever distance is desired for the maximum change in axial length of the travel joint 24 may be selected as a stroke length 64 of the travel joint 24. In the illustrated embodiment, the mandrel 52 may include a projection 66 that extends radially toward the housing 60, while the housing includes two opposing shoulders 68 and 70 extending radially inwardly toward the mandrel 52. It should be noted that in other embodiments, this configuration may be reversed, such that the housing 60 includes a projection that can be moved axially relative to shoulders extending outward from the mandrel 52. The projection 66 may slide with the mandrel 52 relative to the housing 60 as far as the shoulder 68 on one end and the shoulder 70 at the other end. In the illustrated embodiment, this projection 66 may be disposed and locked in a position approximately in the middle of the stroke length 64 (mid-stroke).

An inner production tubing flowline 86 is provided along a length of the travel joint 24 to enable fluid communication from the tubular string portion (e.g., 12A of FIG. 1) at one end of the travel joint 24 to the tubular string portion (e.g., 12B of FIG. 1) at the opposite end of the travel joint 24. The production tubing flowline 86 may include a hollow bore formed through the housing 50 and the mandrel 52 along the length of the travel joint 24. Even as components of the travel joint 24 slide relative to one another to change the length of the tubular string, the production tubing flowline 86 internal to the travel joint 24 may continue to route production fluids through the travel joint 24 and the drill string.

In presently disclosed embodiments, one or more control lines 72 may be routed through the travel joint 24 from one end to the other. These control lines 72 may include electric control lines, hydraulic control lines, fiber optic control lines, or a combination thereof. The control lines 72 may run along the outer diameter of the travel joint 24 at an upper portion of the travel joint 24. At the point where the control lines 72 reach the overlapping portions of the housing 60 and the mandrel 52, the control lines 72 may be routed into and coiled inside an annulus 74 between the housing 60 and the mandrel 52. The coiled configuration of the control lines 72 through this portion of the travel joint 24 may allow the travel joint 24 to telescope without damaging the control lines 72. The control lines 72 may be compressed and extended like a coiled spring, distributing the linear force better than would be possible if they were axially aligned with this portion of the travel joint 24. After this coiled section, the control lines 72 may pass through the projection 66 to lay in grooves 76 formed along the length of the lower portion of the mandrel 52. In some embodiments, the travel joint 24 may include an anti-rotation key 78 placed in a groove radially spaced from groove 76 formed between the housing 60 and the mandrel 52 to prevent turning of the mandrel 52 and the housing 60 relative to each other. As a result, the anti-rotation key 78 may keep the coiled control lines 72 from turning in the annulus 74.

In disclosed embodiments, the travel joint 24 may include a locking mechanism 80 between the housing 60 and the mandrel 52. The locking mechanism 80 may be disposed in a position to selectively lock the mandrel 52 and the tube 50 in an axial position relative to each other that at least partially compresses the travel joint 24. For example, in the illustrated embodiment, the locking mechanism 80 may lock the mandrel 52 in a mid-stroke position, where the travel joint 24 is between a fully extended configuration and a fully compressed configuration.

The locking mechanism 80 used to maintain the travel joint in the mid-stroke position may include a keyed engagement between an outer surface of a portion of the mandrel 52 and an inner surface of a portion of the housing 60. For example, in the illustrated embodiment, the mandrel 52 includes a key 82 formed into the projection 66 and a corresponding profile 84 formed in the housing at a position approximately in the middle of the stroke length 64. In other embodiments, these features may be reversed, so that the key 82 is formed in the housing 60 while the profile 84 is formed in the mandrel 52. In still other embodiments, different types of releasable locking mechanisms 80 may be utilized to lock the travel joint 24 in the mid-stroke position.

The travel joint 24 may be run into the wellbore in the mid-stroke position to set up new completions. The travel joint 24 may be assembled into the mid-stroke position either in a shop environment or at the rig. Referring back to FIG. 1, the travel joint 24 may be locked in the mid-stroke position, and the tubular string 12 with the travel joint 24 may be lowered into the wellbore 20. When the desired depth is reached, the tubular string 12 may land in the wellhead 16, as described above, and the packer 22 may be set. At this point, the locking mechanism 80 may be released so that travel joint 24 can adjust the length of the tubular string 12 to account for stresses and temperature changes. Once the travel joint 24 has released, the mechanism may lock out and not re-engage, allowing the travel joint 24 to adjust its length over a period of time.

When the travel joint 24 is released from the initial mid-stroke position, the mandrel 52 and housing 60 may move relative to each other along the axis 58 in either direction. That is, the travel joint 24 may allow for extension or compression of the tubular string length to compensate for downhole temperatures after releasing the locking mechanism 80. However, using the disclosed system, the travel joint 24 may be initially set at a partially or fully compressed position via the locking mechanism 80, and later released to extend or compress the tubular string. In some embodiments, a similar locking mechanism 80 may be used to set the travel joint 24 in a fully extended position as well.

In presently disclosed embodiments, the travel joint 24 may be released based on a pressure differential between the inner production tubing flowline 86 through a center of the travel joint 24 and the annulus 74 between the mandrel 52 and the housing 60. To facilitate this pressure differential, the travel joint 24 may include a honed tube 50 that seals against one or more seals 88 disposed on the mandrel 52. These seals 88 may isolate the production tubing flowline 86 from the annulus 74, thus preventing fluid flowing through the production tubing flowline 86 from entering the annulus 74. The seals 88 may continuously seal these components from each other, no matter where the mandrel 52 is in relation to the housing 60 along the stroke length 64 of the travel joint 24.

Figure 3:
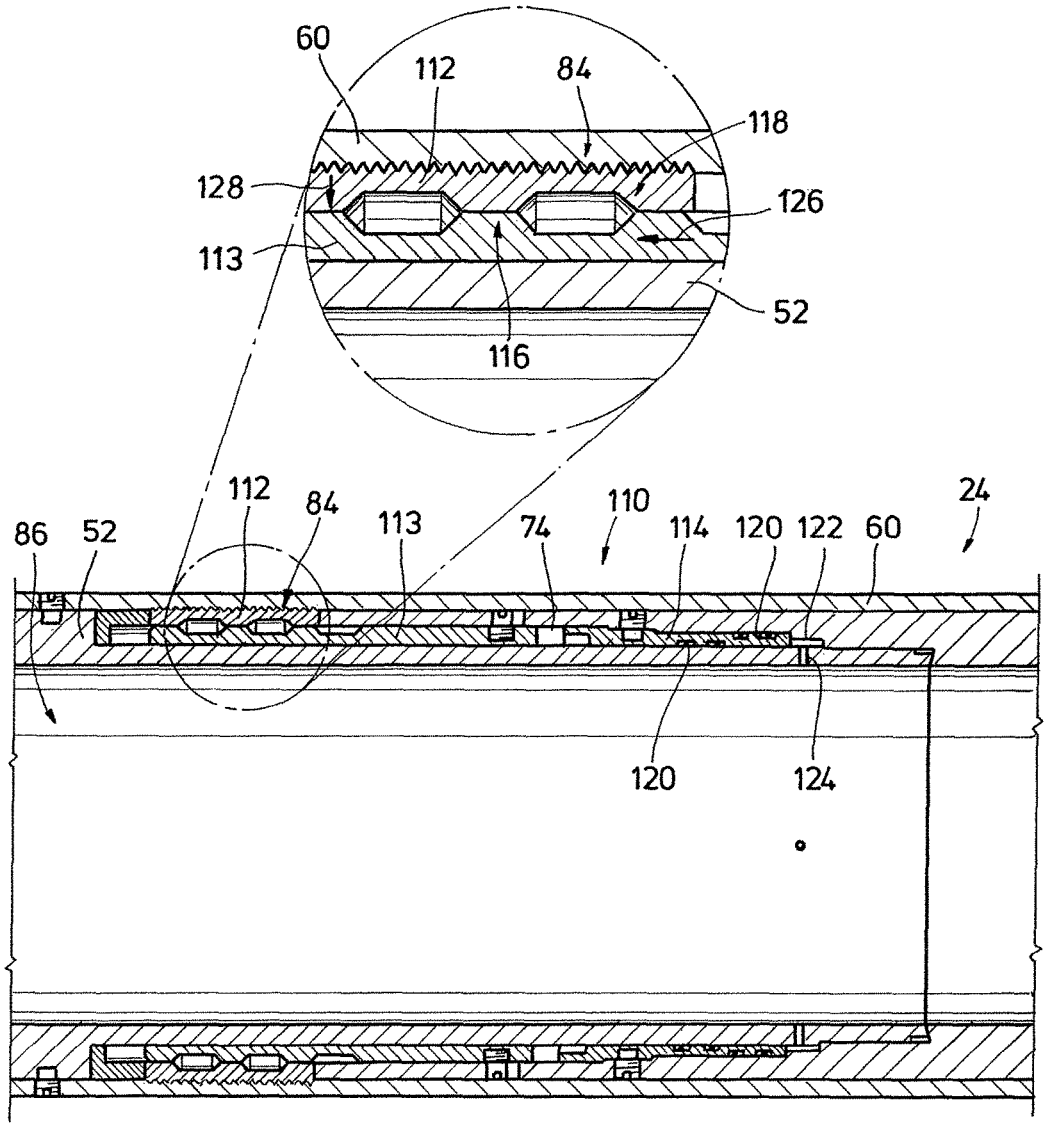
FIG. 3 is a close up cross sectional view of a release mechanism for the travel joint system of FIGS. 1 and 2, in accordance with an embodiment of the present disclosure.

As mentioned above, the travel joint 24 may be released based on the pressure differential between the production tubing flowline 86 and the annulus 74. FIG. 3 illustrates one embodiment of a release mechanism 110 that may be utilized to release the travel joint 24 from the mid-stroke position in this manner. The release mechanism 110 may enable the travel joint 24 to be assembled either in a fully stroked (fully extended) position or mid-stroked (partially extended) position.

The illustrated release mechanism 110 may include a load ring 112 that is engaged with the mating profile 84 of the housing 60 when the travel joint 24 is in the locked position. That is, the load ring 112 functions as the locking key 82 described with reference to FIG. 2. To release the travel joint 24, the load ring 112 may be propped out of engagement with the profile 84 via a prop 113 disposed adjacent a release piston 114. In some embodiments, the prop 113 and the release piston 114 may be part of a single integral piece used to selectively release the load ring 112 from engagement with the profile 84. As shown, the prop 113 may include a keyed outer surface 116 that is designed to mate with a keyed inner surface 118 of the load ring 112. However, in the initial setup, the load ring 112 may be engaged with the mating profile 84 of the housing 60 while the prop 113 is positioned so that the keyed surfaces 116 and 118 are offset from one another. The prop 113 is generally positioned within the annulus 74 between the mandrel 52 and the housing 60, and the piston 114 may include seals 120 disposed at one end to seal the annulus 74 from a separate chamber 122 between the mandrel 52 and the housing 60.

In some embodiments, actuation of the release piston 114 may rely on a pressure differential between the production tubing flowline 86 and the annulus 74. For example, the chamber 122 may be open to the production tubing flowline 86 via a port 124. When it is desirable to release the travel joint 24, fluid may be pumped downhole through the production tubing at relatively higher pressures. The high pressure fluid may flow through the production tubing flowline 86 and the port 124 into the chamber 122. The high pressure fluid in the chamber 122 may be higher than the hydrostatic pressure in the annulus 74, thus shearing one or more shear members (e.g., pin, screw, ring) and forcing the release piston 114 and the prop 113 in a direction (arrow 126) toward the keyed portion 118 of the load ring 112. When the keyed portions 116 and 118 are aligned with each other, the load ring 112 may snap inward (arrow 128) into engagement with the prop 113. From this position, the load ring 112 may be completely disengaged from the profile 84 of the housing 60, thereby allowing the mandrel 52 to move in either direction relative to the housing 60.

Certain features of the release mechanism 110 may enable a relatively smooth and complete release of the mandrel load ring 112 from the housing 60 with the mating profile 84. For example, the load ring 112 may be a C-ring or other type of ring that naturally tries to collapse toward a center region (e.g., toward the prop 113 or release piston 114). In some embodiments, the mating profile 84, the load ring 112, and the prop 113 may feature certain key cuts that facilitate complete collapse of the load ring 112 when released. For example, as illustrated, the keyed portions 116 and 118 of the prop 113 and the load ring 112, respectively, may include relatively squared cuts that make it relatively difficult for the load ring 112 to disengage from the prop 113 after engagement.

Other variations of the illustrated release mechanism 110 may be utilized to release the mandrel 52 from the housing 60 when locked in the mid-stroke or full-stroke positions. For example, other types, shapes, depths, numbers, and lengths of the keyed features (e.g., between the load ring 112 and the housing 60 or between the load ring 112 and the prop 113 or the release piston 114) may be used to engage or disengage the various components during locking and releasing the travel joint 24. In some embodiments, the travel joint 24 may include a hydraulic release device which releases the travel joint in response to a predetermined compressive force being applied to the travel joint for a predetermined amount of time. In other embodiments, the travel joint 24 may include a resetting feature which permits the travel joint 24 to be locked back in its mid-stroke position after having been compressed. In still other embodiments, the travel joint 24 may be one which is released in response to shearing one or more shear pins/screws with axial tension or compression. Further, in certain embodiments, the travel joint 24 may be configured to be released from the mid-stroke or full-stroke position by means of a J-slot or ratchet mechanism.

Figure 4A:
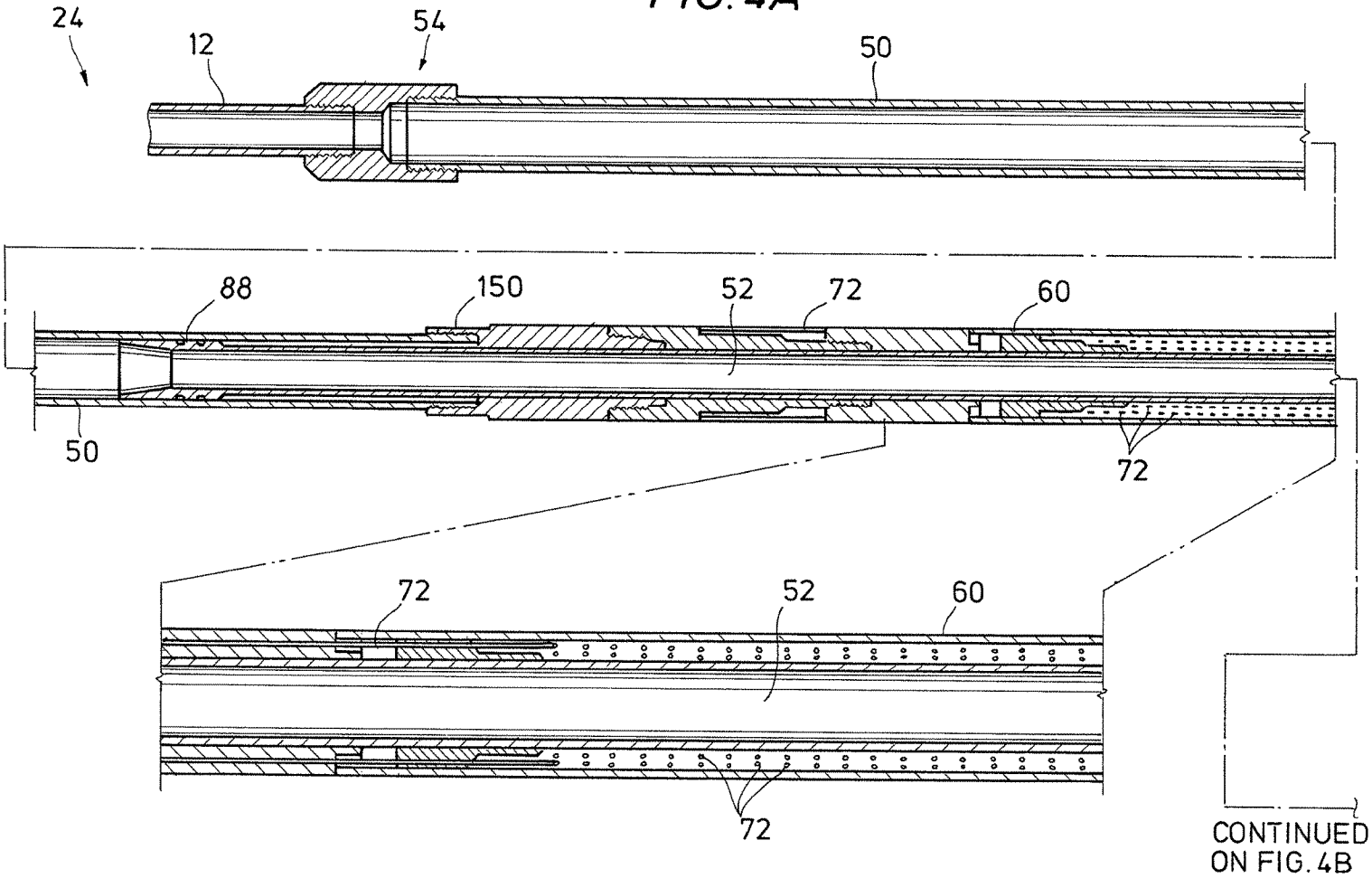
FIGS. 4A and 4B illustrate a cross sectional view of the travel joint system of FIG. 1 in an extended position, in accordance with an embodiment of the present disclosure.
Figure 4B:
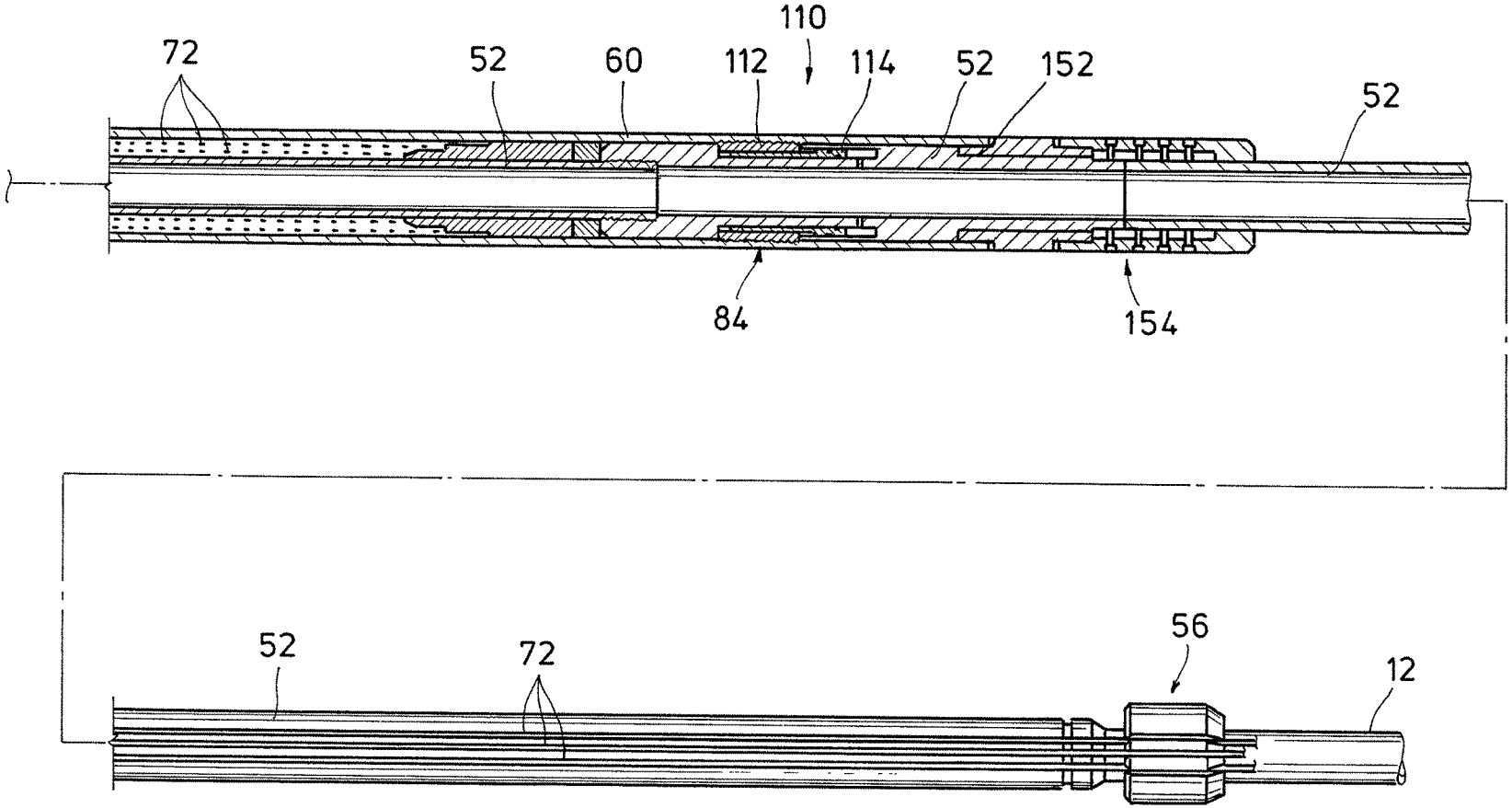

A more detailed view of an embodiment of the disclosed travel joint 24 is provided in FIG. 4. As noted above, the travel joint 24 may include a honed tube 50 that may be coupled to the production tubing 12 at the upper end 54. The travel joint 24 also includes the mandrel 52 that may be coupled to the production tubing 12 at the lower end 56 of the travel joint 24. The travel joint 24 may include the honed tube 50 and one or more seals 88 that provide sealing between the re-entry guide portion of the mandrel 52 and the tube 50. In the illustrated embodiment, internal connections 150 between the tube 50 and the housing 60 may be a premium casing thread, which may offer a relatively high compression strength compared to currently used connectors.

As discussed above, the disclosed housing 60 may include the mating profile 84 formed (e.g., machined) therein for interfacing with the load ring 112. In addition, the load ring 112 is adapted to anchor to the housing 60 (via the mating profile 84) so that the mandrel 52 may be secured in a partially (mid-stroke) or fully (full-stroke) extended position relative to the housing 60. In some embodiments, the travel joint 24 may include mating profiles 84 at both a mid-stroke position and a full-stroke position along the housing 60, so that the load ring 112 may be selectively engaged with the housing 60 at a desired position along the axial length of the travel joint 24.

Figure 5:
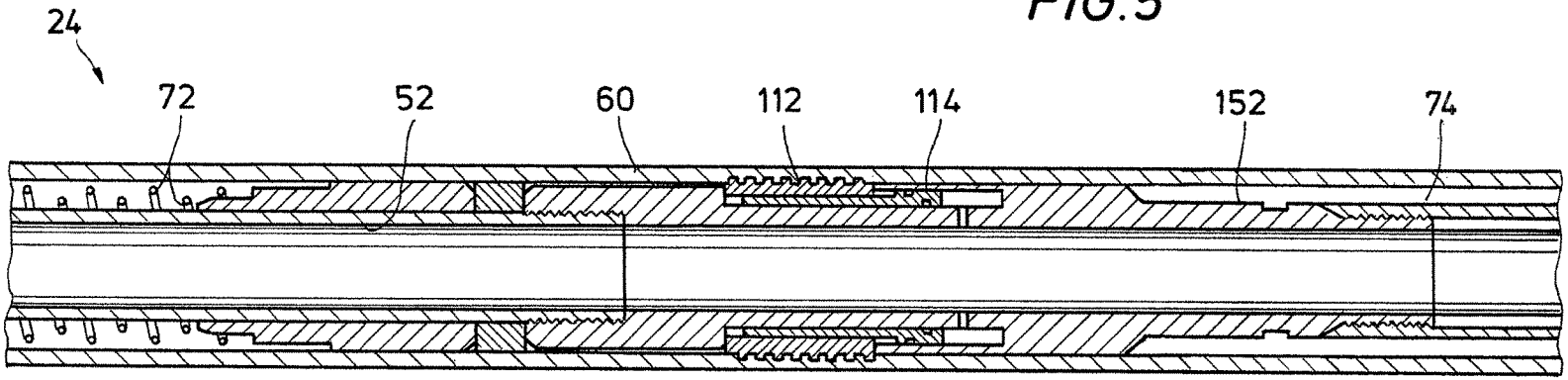
FIG. 5 is a cross sectional view of a portion of the travel joint system of FIG. 1 in a mid-stroke position, in accordance with an embodiment of the present disclosure.

As discussed above, the release piston 114 may release the load ring 112 from the housing 60 in response to increased pressure provided through the travel joint 24. In the illustrated embodiment, the mandrel 52 is locked in the position such that the travel joint 24 is fully extended. In this position, a shoulder 152 formed along a portion of the mandrel 52 is seated at a lower end 154 of the housing 60. An embodiment of the travel joint 24 having the mating profile 84 formed in the housing 60 to lock the mandrel 52 into a mid-stroke position is illustrated in FIG. 5. In this position, the shoulder 152 formed along the mandrel 52 is not seated in an end of the housing 60, but is instead open to the annulus 74 between the housing 60 and the mandrel 52.

As mentioned above with reference to FIG. 1, the travel joint 24 may be run into the wellbore 20 locked in a mid-stroke position. After run in, the packer 22 may be set. This generally involves using a mechanical isolation device (e.g., dropped ball or closed production valve) to block the inside diameter of the production tubing flowline and pressurizing the inside production tubing 12. This pressurization may begin to stretch the tubing. After this, the travel joint 24 may be released as described above, and this may cause the travel joint 24 to stroke relatively fast. Indeed, the tension or compression acting on the tubular string 12 while the travel joint 24 is locked in a mid-stroke or full-stroke position may act like a spring that causes the travel joint 24 to quickly stroke to relieve the residual force. As noted above, quick stroking of the travel joint 24 may be undesirable, since it can put relatively high tensile or compressive stresses on the control lines 72 routed through the travel joint 24. To prevent this quick stroking upon release of the travel joint 24 from a mid-stroke or full-stroke position, the travel joint 24 may include a braking system in some embodiments.

Turning back to FIG. 2, the illustrated travel joint 24 includes an embodiment of one such braking system, which may be a fluid brake 170. The fluid brake 170 may be a hydraulic brake that meters the stroke velocity of the travel joint 24. As illustrated, the fluid brake 170 may include a volume of fluid 172 trapped in a chamber 174 formed between the inner mandrel 52 and the honed tube 50. More specifically, the chamber 174 may be sealed from the production tubing flowline 86 and the annulus 74 by the one or more seals 88 between the end of the mandrel 52 and the tube 50 and by one or more seals 176 formed between another portion of the mandrel 52 and the tube 50. The fluid brake 170 may utilize one or more nozzles 178 disposed on the tube 50 between the chamber 174 and an area outside of the travel joint 24. That way, when the travel joint 24 is disposed in the wellbore (as shown in FIG. 1), the nozzle 178 may regulate and meter a flow of fluid between the chamber 174 and an annulus between the travel joint 24 and the wellbore 20 based on a pressure differential.

The fluid brake 170 may be configured to dampen movement of the mandrel 52 relative to the tube 50 of the travel joint 24 in both axial directions. For example, when the travel joint 24 is in tension at the time of the release of the travel joint 24, the tube 50 and mandrel 52 may move relative to each other in a direction that decreases the volume of the chamber 174. This may push the volume of fluid 172 out of the chamber 174, through the nozzle 178, and out of the travel joint 24 (e.g., into the annulus between the travel joint 24 and the wellbore). When the travel joint 24 is in compression at the time of release, the tube 50 and mandrel 52 may move relative to each other in a direction that increases the volume of the chamber 174. This may draw fluid into the travel joint 24 through the nozzle 178 to fill the chamber 174 and balance the pressure between the outside and the fluid chamber 174. Thus, the fluid brake 170 may provide metered stroking of the travel joint 24 in either direction, providing control for extending or compressing the travel joint 24 after release of the locking mechanism 80.

The travel joint 24 illustrated in FIG. 2 may include both the locking mechanism 80 for locking the travel joint 24 in at least a partially compressed position and the fluid brake 170 for metering the axial movement of the components of the travel joint 24 relative to each other. Once the locking mechanism 80 is released (e.g., via the release mechanism of FIG. 3), the tube 50 and the mandrel 52 may telescope relative to each other to change the axial length of the travel joint 24 and any tubular string coupled thereto. When the travel joint 24 is released, there may be tension or compression on the travel joint 24 to force the travel joint to extend or compress. The fluid brake 170 may then meter the stroking of the travel joint 24 to keep the components of the travel joint 24 from being forced together or apart too quickly.

Figure 6:
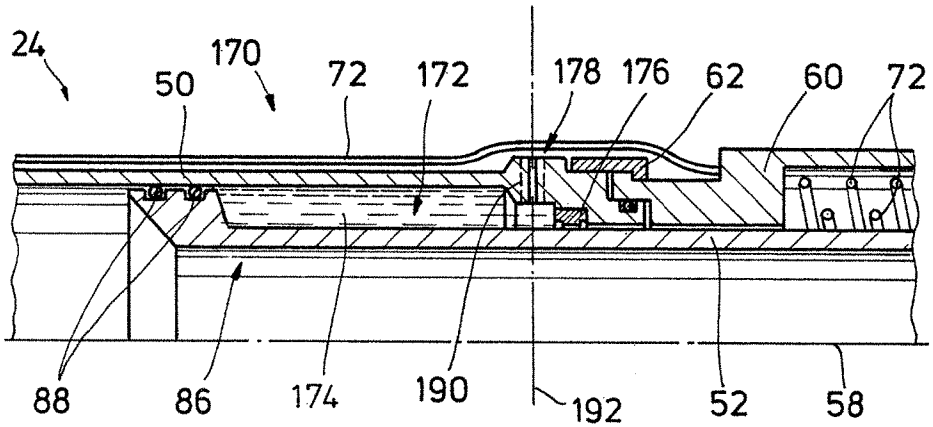
FIG. 6 is a schematic cross sectional view of a fluid brake used in a travel joint, in accordance with an embodiment of the present disclosure.

Although illustrated as part of the same travel joint 24 having the locking mechanism 80 for holding the travel joint 24 in a mid-stroke or full-stroke position, the fluid brake 170 may be disposed in other types of travel joints 24. For example, travel joints 24 that do not include locking mechanisms at all may utilize a similar fluid brake 170 to meter the stroking of the mandrel 52 relative to the housing 60. FIG. 6 illustrates a detailed embodiment of the fluid brake 170 that may be used with the travel joint 24.

In addition to the components described above, some embodiments of the fluid brake 170 may include a rupture disk 190 disposed proximate the nozzle 178. The rupture disk 190 may be used to prevent over pressurization of the tube 50 and/or to prevent exceeding pressure limits of the seals 88 and 176. The rupture disk 190, which is shown in broken lines in FIG. 6, may be disposed within the same plane 192 as the nozzle 178, extending radially through the tube 50 but at a different angle of rotation about the axis 58 of the travel joint 24. The rupture disk 190 may remain closed until a pressure differential between the chamber 174 and the outside of the travel joint 24 reaches a limit. Once this limit is reached, the rupture disk 190, with a larger diameter than the nozzle 178, may rupture, allowing fluid to move between the chamber 174 and outside the travel joint 24. This may be beneficial when a relatively dirty fluid attempts to flow through the nozzle 178, but instead clogs the nozzle 178.

Although not illustrated, in some embodiments, the nozzle 178 and/or rupture disk 190 may be disposed through a portion of the mandrel 52 adjacent the chamber 174, instead of through the tube 50. That is, the nozzle 178 and/or rupture disk 190 may provide flowpaths between the chamber 174 of the fluid brake 170 and the production tubing flowline 86 through the center of the mandrel 52. In such embodiments, the fluid brake 170 may still meter the velocity of extension or compression of the travel joint 24 by dampening movement of the mandrel 52 relative to the tube 50. For example, when the travel joint 24 is in tension, the tube 50 and mandrel 52 may move relative to each other in a direction that decreases the volume of the chamber 174. This may push the volume of fluid 172 out of the chamber 174, through the nozzle 178, and into the production tubing flowline 86. When the travel joint is in compression, the tube 50 and mandrel 52 may move relative to each other in a direction that increases the volume of the chamber 174. This may draw fluid into the travel joint 24 through the nozzle 178 to fill the chamber 174 and balance the pressure between the production tubing flowline 86 and the fluid chamber 174.

Embodiments disclosed herein include:

A. A method that includes disposing a travel joint coupled to a tubing string into a wellbore, the travel joint including a tube and a mandrel slidably positioned in an inner portion the tube, wherein the mandrel is locked into an axial position relative to the tube. The method also includes releasing the travel joint by unlocking the mandrel from the axial position relative to the tube to allow the mandrel and the tube to slide relative to each other. In addition, the method includes damping an axial movement between the mandrel and the tube via a fluid brake of the travel joint.

B. A travel joint system including a tube disposed at a first end of a travel joint and a mandrel disposed at a second end of the travel joint opposite the first end. The mandrel is partially disposed in a hollow portion of the tube, and the tube and the mandrel are axially slidable relative to each other to extend or compress the travel joint. The travel joint system also includes a housing coupled to the tube and disposed around the mandrel, and a locking mechanism between the housing and the mandrel disposed in a position to selectively lock the mandrel and the tube in an axial position relative to each other.

C. A travel joint system including a tube disposed at a first end of a travel joint and a mandrel disposed at a second end of the travel joint opposite the first end. The mandrel is partially disposed in a hollow portion of the tube, and the tube and the mandrel are axially slidable relative to each other to extend or compress the travel joint. The travel joint system also includes a fluid brake including a fluid chamber disposed between the mandrel and the tube to dampen axial movement between the mandrel and the tube.

Each of the embodiments A, B, and C may have one or more of the following additional elements in combination: Element 1: wherein releasing the travel joint comprises releasing the travel joint by unlocking the mandrel from a fully extended position relative to the tube. Element 2: wherein releasing the travel joint comprises releasing the travel joint by unlocking the mandrel from a half extended position relative to the tube. Element 3: wherein the mandrel is locked into an axial position relative to the tube. Element 4: wherein the travel joint includes one or more control lines routed therethrough. Element 5: wherein the one or more control lines include a hydraulic line, an electric line, a fiber optic cable, or some combination thereof. Element 6: further including releasing the travel joint when the travel joint is in tension or in compression. Element 7: further including landing a tubing hanger, wherein the tubing string is coupled to the tubing hanger, applying pressure to set a packer in the wellbore, and releasing the travel joint when the travel joint is in tension or compression due to the pressure applied to set the packer. Element 8: wherein damping an axial movement between the mandrel and the tube includes routing fluid out of a fluid chamber formed between the mandrel and the tube to dampen an axial movement of the mandrel away from the tube while axially moving the travel joint. Element 9: wherein damping the axial movement between the mandrel and the tube includes routing fluid out of the fluid chamber and into an annulus between the travel joint and the wellbore. Element 10: wherein damping the axial movement between the mandrel and the tube includes routing fluid out of the fluid chamber and into a production tubing flowline. Element 11: wherein damping an axial movement between the mandrel and the tube includes routing fluid into a fluid chamber formed between the mandrel and the tube to dampen an axial movement of the mandrel. Element 12:

further including compressing the one or more control lines during an axial movement between the mandrel and the tube that compresses the travel joint and extending the one or more control lines during an axial movement between the mandrel and the tube that extends the travel joint, wherein the one or more control lines are coiled between the mandrel and a housing coupled to the tube. Element 13: wherein unlocking the mandrel from the axial position relative to the tube includes disengaging a keyed feature disposed on the mandrel from an inner surface of a housing coupled to the tube. Element 14: further including releasing the travel joint based on a pressure differential between a production tubing flowline through the travel joint and an annulus between the mandrel and a housing coupled to the tube.

Element 15: further including a release mechanism for releasing the locking mechanism based on a pressure differential between a production tubing flowline through the travel joint and an annulus between the housing and the mandrel. Element 16: wherein the locking mechanism is disposed in a position to lock the mandrel and the tube in a mid-stroke position relative to each other that positions the travel joint between a fully compressed state and a fully extended state. Element 17: wherein the locking mechanism is disposed in a position to lock the mandrel and the tube in a full-stroke position relative to each other that positions the travel joint in a fully extended state. Element 18: wherein the locking mechanism includes a keyed engagement between an outer surface of a portion of the mandrel and an inner surface of a portion of the housing. Element 19: further including a release piston with a keyed surface that matches an inner surface of the portion of the mandrel to receive and release the portion of the mandrel from the keyed engagement with the housing. Element 20: further including a fluid brake comprising a fluid chamber disposed between the mandrel and the tube to dampen axial movement between the mandrel and the tube when the locking mechanism is released.

Element 21: wherein the fluid brake further includes a nozzle disposed through a section of the tube and forming a restricted flowpath between the fluid chamber and a position outside the travel joint. Element 22: wherein the fluid brake further includes a nozzle disposed through a section of the mandrel and forming a restricted flowpath between the fluid chamber and a production tubing flowline through the travel joint. Element 23: wherein the fluid brake further includes a nozzle and a rupture disk disposed in a portion of the travel joint adjacent the fluid chamber. Element 24: further including a locking mechanism disposed in a position between the mandrel and a housing coupled to the tube to selectively lock the mandrel and the tube in an axial position relative to each other.

Although the present disclosure and its advantages have been described in detail, it should be understood that various changes, substitutions and alterations can be made herein without departing from the spirit and scope of the disclosure as defined by the following claims.

What is claimed is:

1. A method, comprising:

disposing a travel joint coupled to a tubing string into a wellbore, the travel joint comprising a tube and a mandrel slidably positioned in an inner portion the tube, wherein the mandrel is locked into an axial position relative to the tube;

releasing the travel joint by unlocking the mandrel from the axial position relative to the tube to allow the mandrel and the tube to slide relative to each other; and damping an axial movement between the mandrel and the tube via a fluid brake of the travel joint, wherein damping an axial movement between the mandrel and the tube comprises routing fluid out of or into a fluid chamber formed between the mandrel and the tube through a nozzle to dampen an axial movement of the mandrel in relation to the tube while axially moving the travel joint.

2. The method of claim 1, wherein releasing the travel joint comprises releasing the travel joint by unlocking the mandrel from a fully extended position relative to the tube or from a half extended position relative to the tube.

3. The method of claim 1, further comprising:

landing a tubing hanger, wherein the tubing string is coupled to the tubing hanger;

applying pressure to set a packer in the wellbore; and releasing the travel joint when the travel joint is in tension or compression due to the pressure applied to set the packer.

4. The method of claim 1, wherein damping the axial movement between the mandrel and the tube comprises routing fluid between the fluid chamber and an annulus between the travel joint and the wellbore.

5. The method of claim 1, wherein damping the axial movement between the mandrel and the tube comprises routing fluid between the fluid chamber and a production tubing flowline.

6. The method of claim 1, further comprising:

compressing one or more control lines routed through the travel joint during an axial movement between the mandrel and the tube that compresses the travel joint; and extending the one or more control lines during an axial movement between the mandrel and the tube that extends the travel joint;

wherein the one or more control lines are coiled between the mandrel and a housing coupled to the tube.

7. The method of claim 1, wherein unlocking the mandrel from the axial position relative to the tube comprises disengaging a keyed feature disposed on the mandrel from an inner surface of a housing coupled to the tube.

8. A travel joint system, comprising:

a tube disposed at a first end of a travel joint;

a mandrel disposed at a second end of the travel joint opposite the first end, wherein the mandrel is partially disposed in a hollow portion of the tube, and wherein the tube and the mandrel are axially slidable relative to each other to extend or compress the travel joint;

a housing coupled to the tube and disposed around the mandrel;

a locking mechanism between the housing and the mandrel disposed in a position to selectively lock the mandrel and the tube in an axial position relative to each other; and a release mechanism for releasing the locking mechanism based on a pressure differential between a production tubing flowline through the travel joint and an annulus between the housing and the mandrel.

9. The travel joint system of claim 8, wherein the locking mechanism is disposed in a position to lock the mandrel and the tube in a mid-stroke position relative to each other that positions the travel joint between a fully compressed state and a fully extended state.

10. The travel joint system of claim 8, wherein the locking mechanism is disposed in a position to lock the mandrel and the tube in a full-stroke position relative to each other that positions the travel joint in a fully extended state.

11. The travel joint system of claim 8, wherein the locking mechanism comprises a keyed engagement between an outer surface of a portion of the mandrel and an inner surface of a portion of the housing.

12. The travel joint system of claim 11, further comprising a release piston configured to release the mandrel from the tube when in a locked position.

13. The travel joint system of claim 8, further comprising a fluid brake comprising a fluid chamber disposed between the mandrel and the tube to dampen axial movement between the mandrel and the tube when the locking mechanism is released.

14. A travel joint system, comprising:

a tube disposed at a first end of a travel joint;

a mandrel disposed at a second end of the travel joint opposite the first end, wherein the mandrel is partially disposed in a hollow portion of the tube, and wherein the tube and the mandrel are axially slidable relative to each other to extend or compress the travel joint; and a fluid brake comprising:

a fluid chamber disposed between the mandrel and the tube to dampen axial movement between the mandrel and the tube; and a nozzle that forms a restricted flowpath in relation to the fluid brake.

15. The travel joint of claim 14, wherein the nozzle is disposed through a section of the tube and forms the restricted flowpath between the fluid chamber and a position outside the travel joint.

16. The travel joint of claim 14, wherein the nozzle is disposed through a section of the mandrel and forms the restricted flowpath between the fluid chamber and a production tubing flowline through the travel joint.

17. The travel joint of claim 14, wherein the fluid brake further comprises a rupture disk disposed in a portion of the travel joint adjacent the fluid chamber.

18. The travel joint of claim 14, further comprising a locking mechanism disposed in a position between the mandrel and a housing coupled to the tube to selectively lock the mandrel and the tube in an axial position relative to each other.

* * * * *